US005851018A

United States Patent [19]

Curran et al.

[11] Patent Number: 5,851,018

[45] Date of Patent: Dec. 22, 1998

[54] CAMBER ADJUSTMENT ASSEMBLY FOR A WHEELCHAIR

[75] Inventors: Neal J. Curran, Lakewood; Wally Radjenovic, Parma, both of Ohio; Christopher J. Peterson, Tierra Verde, Fla.

[73] Assignee: Invacare Corporation, Elyria, Ohio

[21] Appl. No.: 745,646

[22] Filed: Nov. 12, 1996

[51] Int. Cl.[6] ..... A61G 5/00

[52] U.S. Cl. ..... 280/250.1; 280/661

[58] Field of Search ..... 280/250.1, 304.1, 280/661; 180/906

[56] References Cited

U.S. PATENT DOCUMENTS 4,852,899 8/1989 Kueschall ..... 280/250.1

FOREIGN PATENT DOCUMENTS

WO 96/19961 7/1996 WIPO ..... 280/250.1

*Primary Examiner*—J. J. Swann
*Assistant Examiner*—Jim McClellan
*Attorney, Agent, or Firm*—Hudak & Shunk Co., L.P.A.

[57] ABSTRACT

The present invention is directed to a lightweight wheelchair having adjustable wheel camber, adjustable toe-in/toe-out positions, and front-to-rear adjustment of the wheel assembly relative to the frame. The wheel camber is changed by removable camber tubes having plugs in opposite ends with different angular relationships. The camber tube is removed from an axle tube, rotated through one hundred eighty degrees, and reinserted to change the wheel camber. The location of the angular recesses in the camber plugs addresses minor toe-in/toe-out adjustments while rotation of an axle tube provided with indicia assures that proper toe-in/toe-out adjustment is provided for larger wheel camber adjustments. The front to rear location of the wheels relative to the frame can be adjusted via a single fastener on each side. Moreover, the track width of the rear wheels can be adjusted in response to the change in wheel camber.

23 Claims, 11 Drawing Sheets

CAMBER ADJUSTMENT ASSEMBLY FOR A WHEELCHAIR

BACKGROUND OF THE INVENTION

This invention pertains to the art of wheelchairs and, more particularly, to adjustable wheelchairs. The invention finds particular application in a lightweight wheelchair such as a sport wheelchair in which adjustments of the wheel camber and toe-in/toe-out relationships are desired. It will be appreciated, however, that the invention is not limited to lightweight wheelchairs or sport wheelchairs, but may be advantageously employed in other environments and applications such as racing chairs, hand crank bicycles etc.

It is known in the prior art to provide different cambers for the wheels of a wheelchair. Increased maneuverability and turning ability can be achieved by altering the wheel camber. A zero degree camber is defined as a wheel camber where the axles are disposed horizontally and thus the wheels are located perpendicular to the ground surface, i.e., in a vertical plane. Altering the camber results in the wheels rotating in a plane angled relative to vertical so that the wheel axles are angled relative to horizontal, typically where the top of the wheels are disposed closer to the wheelchair seat than the bottom of the wheels.

To alter the camber in commercially available arrangements, it is necessary to remove the wheel from one side of the wheelchair, insert new components, re-assemble the components, and then repeat the procedure for the other wheel. This requires that multiple components or inventory be maintained on-hand such as washers, shims, etc., or the user must special order components to change the camber. These known arrangements are also labor-intensive and tedious if a user desires to change from one wheel camber to another.

Still another adjustment consideration is the toe-in/toe-out adjustment. This relates to orienting the wheels about their respective vertical axes so that as the camber changes, proper positioning of the wheels for wear and drag characteristics is achieved. Therefore, the toe-in/toe-out relationship is very important. By altering the wheel camber, it becomes necessary to fine tune the toe-in/toe-out relationship of the wheels. Unfortunately, toe-in/toe-out adjustment is not always provided on wheelchairs that provide camber adjustment, or there is no easy manner of achieving the desired toe-in/toe-out relationship for a given camber. For those wheelchairs that do provide toe adjustment, there is no predetermined means or indicia to provide proper toe-in/toe-out alignment of the wheels for a given camber. Instead, the toe-in/toe-out adjustment is often estimated.

Fitting through doorways is also a primary concern for wheelchair users. Providing various adjustment features in a wheelchair can result in an extended track width that makes it difficult to pass through doorways. Thus, pulling the wheels inwardly in a direction along their axles toward the seat, i.e. reducing the track width, is highly desirable.

Still another desired adjustment option is altering the front-to-rear center of gravity. Known wheelchair structures use a bracket secured to side frame members of the wheelchair to selectively position the axles toward the front or rear. These structural arrangements typically require a large number of fasteners to secure the wheels at the desired position on the frame. This inhibits easy and quick changeover as desired by the wheelchair user.

One prior art example of an adjustable lightweight wheelchair is shown and described in U.S. Pat. No. 4,852,899 to Kueschall. In that patent, it is taught that the seat can be moved forwardly and rearwardly by a pair of telescoping tubes. The seat height can be adjusted by altering the position of a clamp upwardly or downwardly along a support element. The positions of the rear wheels can be moved forwardly and rearwardly by rotating the clamp one hundred eighty degrees, and the front wheels are correspondingly moved by repositioning a clamp connector along the frame sections in connection with adjusting the seat height.

With respect to camber adjustment, the Kueschall patent teaches that opposite ends of the rear axle can be angularly bored with axle-receiving portions (FIG. 7). This patent does not, however, describe an easy way to quickly change between two different camber angles. Moreover, this patent does not address the ability to adjust the rear wheel base width, again, preferably in a quick change fashion.

Another known adjustable wheelchair arrangement is shown and described in WO 96/19961 (No Limit Designs, Inc.). It represents a different approach to altering the camber of the rear or drive wheels in a lightweight wheelchair by using a splined axle and frame assembly that allows the axle housing to be rotated in four degree increments relative to the frame. Moreover, the axle housing can be selectively moved forwardly and rearwardly along the frame. The desired toe-in/toe-out relationship is maintained by adjusting the front caster wheel assembly. Further, the track width of the rear wheels is adjustable in increments to position the top of the rear wheels away from the frame as the camber angle is increased.

SUMMARY OF THE INVENTION

The present invention contemplates a new and improved wheelchair that overcomes the above-referenced problems and others and provides a secure mechanism for adjusting the wheelchair.

According to the present invention, camber, toe-in/toe-out alignment, rear wheelbase width, and front to rear center of gravity position can all be easily and quickly adjusted.

According to a preferred embodiment, there is provided an axle tube that is substantially fixed in its geometrical relationship with the remainder of the wheelchair frame. Hollow ends of the axle tube receive camber tubes in telescopic relation. Opposite ends of the camber tubes receive camber plugs having machined openings or recesses at different camber angles. In this manner, rotating the camber tubes through one hundred eighty degrees presents first and second desired camber angles.

In accordance with another aspect of the invention, clamps securely position each camber tube within the axle tube so that the camber of the wheels can be easily adjusted.

According to yet another aspect of the invention, the axle tube can be rotated relative to the frame while otherwise maintaining its fixed geometrical relationship with the frame so that toe-in/toe-out adjustment of the wheels is easily obtained with the selected camber. Indicia provided on the axle tube allows the desired toe-in/toe-out adjustment to be achieved without having to alter the remaining frame geometry.

According to yet another aspect of the invention, the telescopic relationship between the axle tube and the camber tube allows the rear wheel base track width to be infinitely adjustable over a predetermined length.

Still another aspect of the invention relates to use of a single fastener on each side of the wheelchair to vary the front-to-rear center of gravity.

A principal advantage of the invention is the ability to easily change the camber of a wheelchair by either rotating the camber tube or replacing the camber tube.

Another advantage of the invention is the ability to obtain still further camber angles by using another set of camber plugs compatible with the remaining components of the wheelchair.

Still another advantage of the invention resides in the ability to easily and precisely adjust the toe-in/toe-out position of the wheels.

Yet another advantage of the invention is found in the ability to easily adjust the track width of the rear wheels.

A further advantage resides in the use of a single fastener on each side of the wheelchair to adjust the location of the rear wheels relative to the frame.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred embodiments of which will be described in detail in this specification and illustrated in the accompanying drawings which form a part hereof, and wherein.

DETAILED DESCRIPTION OF THE PREFERRED EMBODIMENT

Figure 1:
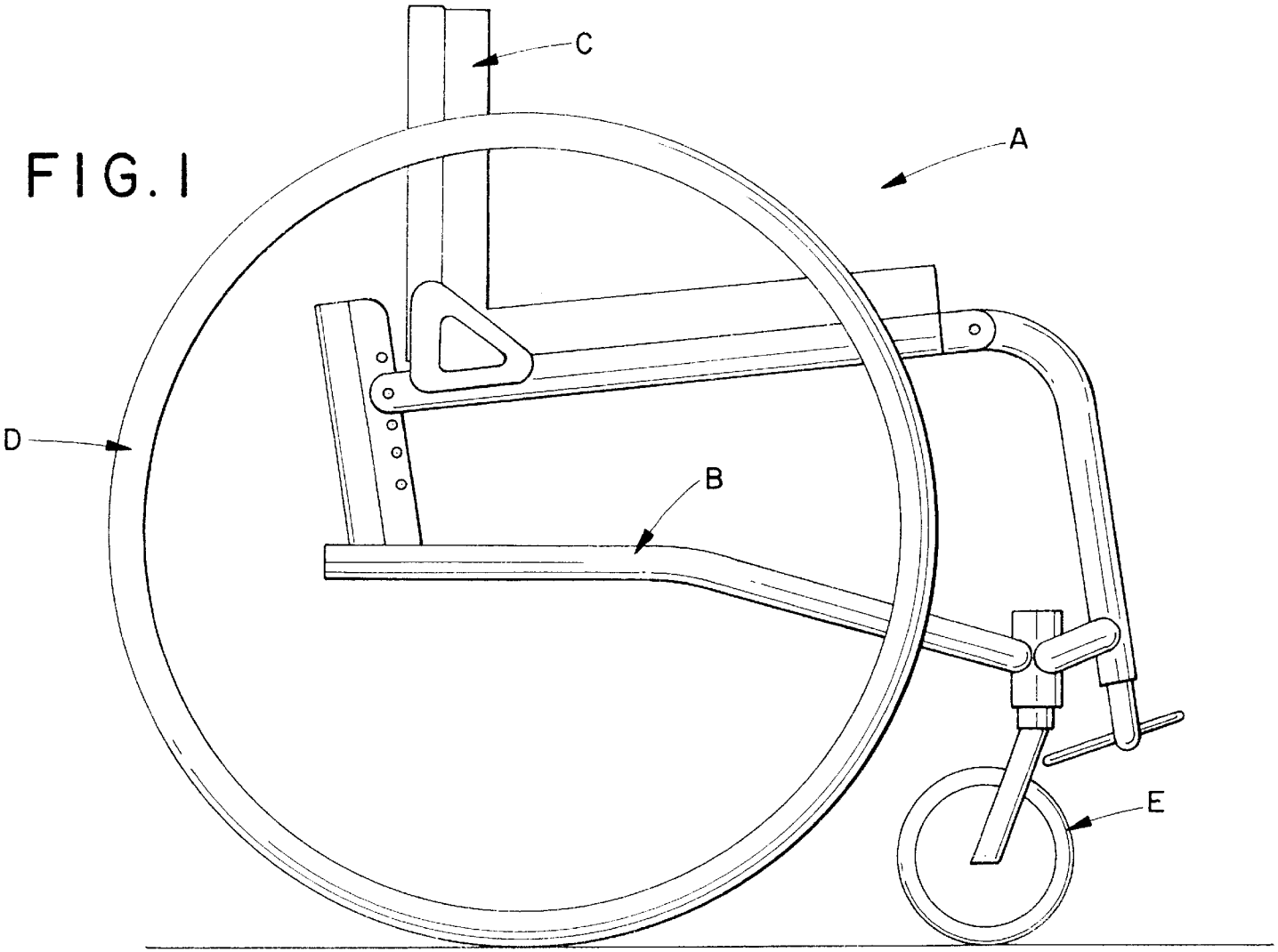
FIG. 1 is an elevational view of an adjustable wheelchair incorporating the subject invention.

Referring now to the drawings wherein the showings are for the purposes of illustrating the preferred embodiment of the invention only and not for purposes of limiting same, the FIGURES show a wheelchair A, preferably a sport wheelchair, having a lightweight frame B that supports a seat assembly C. A pair of rear wheels D are of enlarged diameter relative to the small diameter, caster mounted front wheel(s) E.

Figure 2:
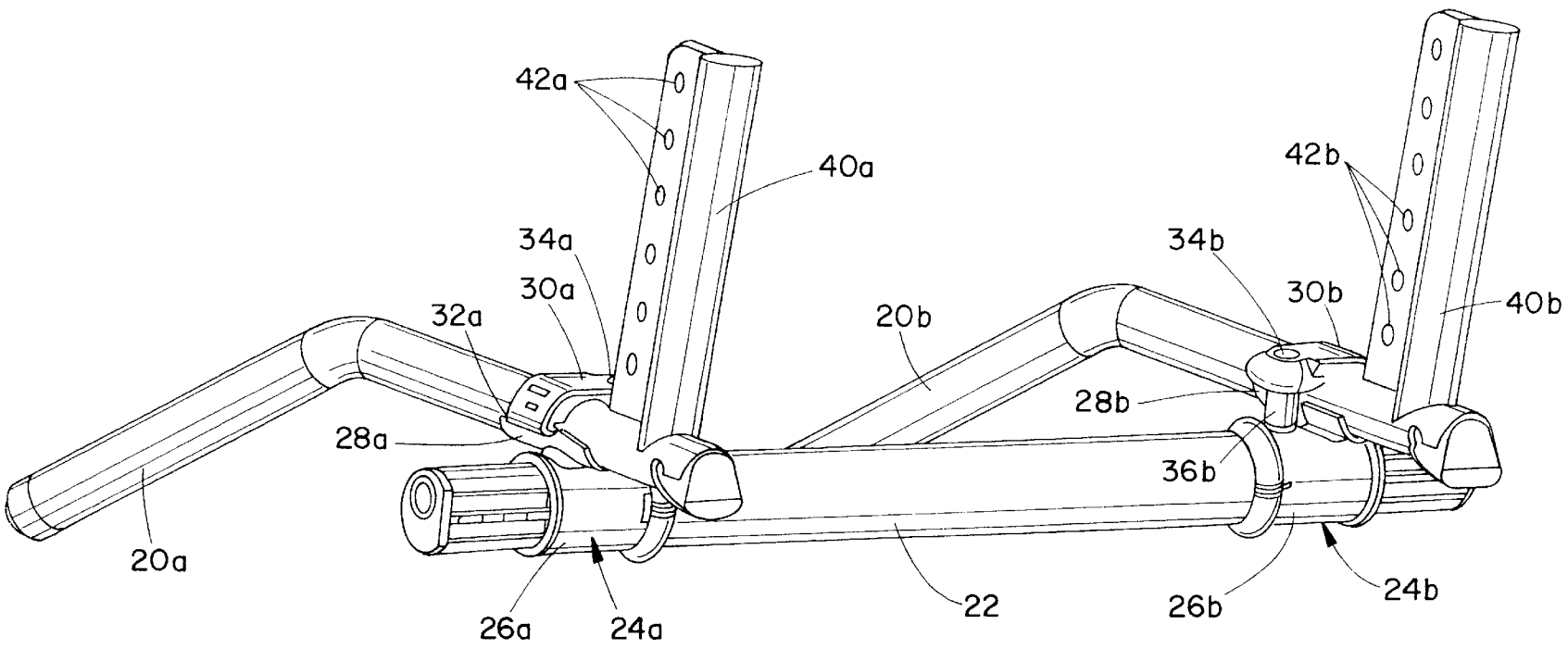
FIG. 2 is a rear, left-hand perspective view of the frame components of the wheelchair of FIG. 1.

Turning particularly to FIG. 2, the features of the subject invention are shown in greater detail. For ease of illustration and understanding, the seat assembly and wheels have been removed. Thus, the frame B is shown as including a pair of first and second side frame members 20*a*, 20*b* disposed in generally parallel relation and preferably being formed of tubular metal. At a front end of each side frame member is mounted the front wheel(s) B and a rear end of each side frame member is located beneath the seat assembly. As will be recognized, the right-hand and left-hand components of the subject wheelchair are substantially identical, i.e., mirror images of one another, so that description of one is fully applicable to the other unless particularly noted otherwise. Moreover, for consistency and ease of understanding, like members will be referred to with the suffix a, b.

The rear ends of the frame members 20*a*, 20*b* are secured to an axle member or tube 22. Preferably, a pair of frame brackets 24*a*, 24*b* receive opposite ends of the axle tube 22 therein. Particularly, cylindrical portions 26*a*, 26*b* of the frame brackets are received about the outer periphery of the axle tube ends. Integrally formed or welded to the cylindrical portion 26 of each frame bracket is a saddle-shaped or U-shaped recess 28 that receives a lower portion of the side frame members 20*a*, 20*b* in mating relation therein. An upper clamp member 30*a*, 30*b* has a curled lip portion 32 that cooperates with an underside of the recess 28 for securing one end of the clamp member 30. Once the frame bracket is received in the recess 28, the clamp member is located in place with the lip 32 and the clamp member pivoted or rotated over the upper peripheral portion of the frame member. A single fastener 34 is then received though an opposite end of the clamp member for receipt in a threaded boss 36 in the frame bracket.

As perhaps best shown in FIG. 2, the frame bracket and clamp member is secured along a horizontal portion of the side frame member, preferably forwardly of an upstanding seat frame portion 40. The seat frame portion includes a series of openings 42 for adjustably securing the seat assembly C to the frame. For reasons which will become more apparent below, the frame brackets 24 may be secured at various axial locations along the horizontal portion of each frame member. This allows the front to rear center of gravity of the wheelchair to be selectively altered merely by loosening or tightening a single fastener 34 on each side of the wheelchair. Of course it will be understood that the features of the subject invention may be used on a fixed frame assembly without departing from the scope and intent of the invention.

Figure 3:
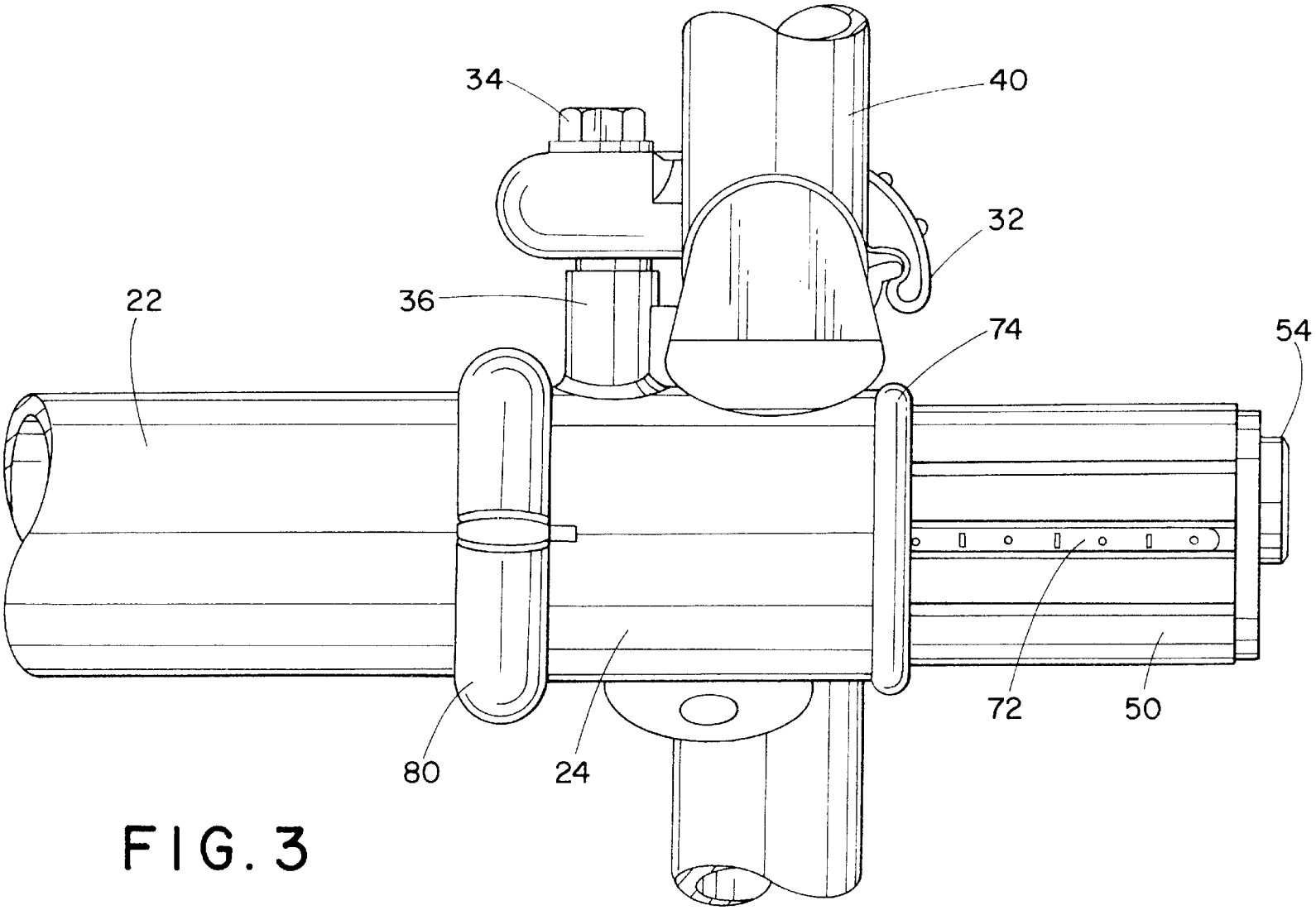
FIG. 3 is a rear elevational view of the frame and axle arrangement for the right-hand wheel.
Figure 4A:
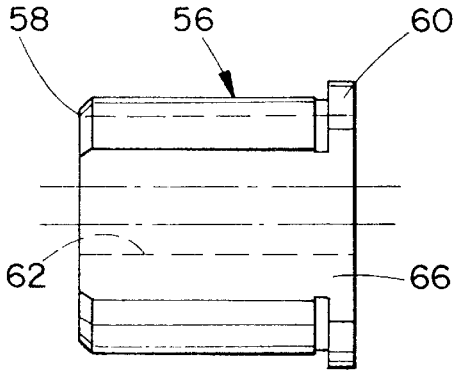
FIGS. 4A and 4B are front elevational and right-hand end views, respectively, of a zero degree camber plug.
Figure 4B:
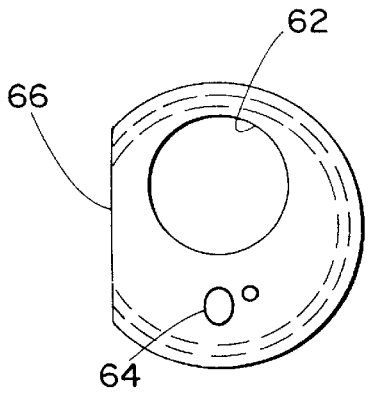

With continued reference to FIG. 2, FIG. 3 more particularly illustrates a camber members or tubes 50*a*, 50*b* received in opposite ends of the axle tube 22. Preferably, each camber tube is telescopically received within the axle tube so that each camber tube can be extended and retracted relative to the axle tube to adjust the track width of the rear wheels. The camber tube is itself a hollow tubular structure and adapted to receive a pair of camber plugs 52, 54 in opposite ends thereof. As shown in greater detail in FIG. 4A through FIG. 8B, a series of camber plugs are provided by a manufacturer. Each camber plug has substantially the same construction, namely, a generally constant diameter body portion 56 that is chamfered at 58 at one end and has a radial shoulder 60 at the other end. A counterbore 62 extends through the camber plug at a preselected angle and position. For example, FIGS. 4A and 4B illustrate a zero degree camber plug. The counterbore is formed at the manufacturer and extends through the plug member for receipt of a wheel axle. Since it is a zero degree camber plug, the axis of the counterbore is parallel to the axis of the body 56. For geometrical reasons associated with the toe-in/toe-out relationship to be described below, the zero degree counterbore is preferably offset from the longitudinal axis of the camber plug body, particularly located above the longitudinal axis at the 12 o'clock position (FIG. 4B). Thus, with the zero degree camber plug, the counterbore is located at the same location relative to the longitudinal axis at the chamfer and shoulder ends of the plug.

Each camber plug may also be stamped or otherwise marked with indicia 64 that indicates the camber angle on an external surface of the plug. Moreover, each plug preferably has a flat surface 66 or other keyed structure for properly orienting the camber plug in the camber tube. Of course alternative key or orienting structural arrangements can be used without departing from the scope and intent of the subject invention.

Figure 5A:
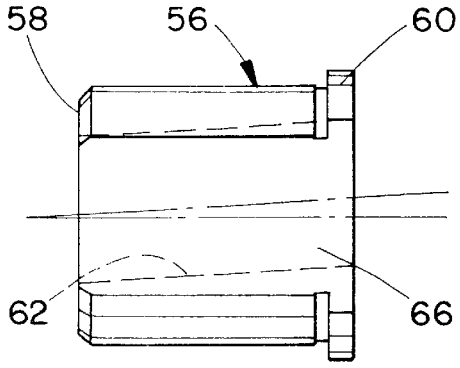
FIGS. 5A and 5B are front elevational and right-hand end views, respectively, of a three degree camber plug.
Figure 5B:
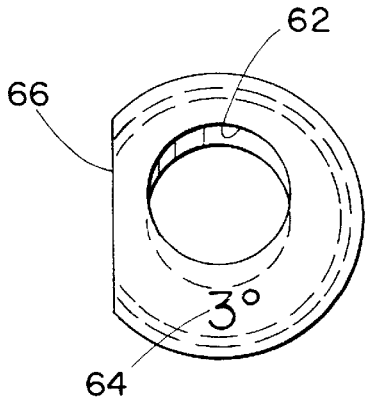

FIGS. 5A and 5B illustrate a second camber plug, for example, a three degree camber plug. Again, the body, chamfer, and shoulder relationship are substantially identical to that of FIG. 4A. The primary distinction is that counterbore 62 is disposed at a different angle, here three degrees, relative to the longitudinal axis of the body. Preferably, this angle is a positive angle as measured from the chamfer end toward the shoulder end of the body. Moreover, and as apparent from a comparison of FIGS. 5B and 4B, the geometrical location of the counterbore is also important, so that as it extends from the shoulder end of the plug, the three degree counterbore is disposed slightly closer to the longitudinal axis of the body. Stated another way, the axis of the counterbore is substantially aligned with the longitudinal axis of the body at the chamfer end of the plug and diverges outwardly as the counterbore proceeds toward the shoulder end of the plug. Nevertheless, the offset dimension of the counterbore axis and the longitudinal axis of the plug body at the shoulder end is less than that of the zero degree camber plug. This compensates for the toe-in/toe-out adjustment corresponding to the change in camber.

Figure 6A:
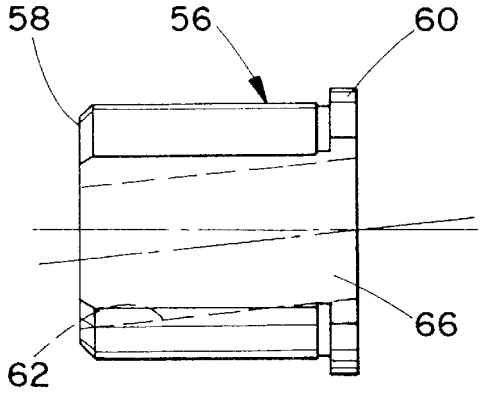
FIGS. 6A and 6B are front elevational and right-hand end views, respectively, of a six degree camber plug.
Figure 6B:
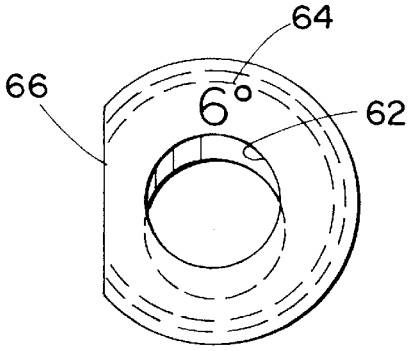

FIGS. 6A and 6B similarly illustrate a different angle in a camber plug, particularly a six degree camber plug. Again, the body, chamfer, and shoulder dimensions are substantially identical. In this plug, however, the axis of the counterbore at the shoulder end of the body is even more closely disposed to the longitudinal axis of the body than in the three degree or zero degree camber plugs described above. Thus, the axis of the counterbore is disposed substantially below the longitudinal axis of the camber plug at the chamfer end of the plug body. These geometrical relationships between the location angled counterbores relative to the longitudinal axis of the camber plug are, again, for reasons of toe-in/toe-out adjustment and will become more apparent below.

Figure 7A:
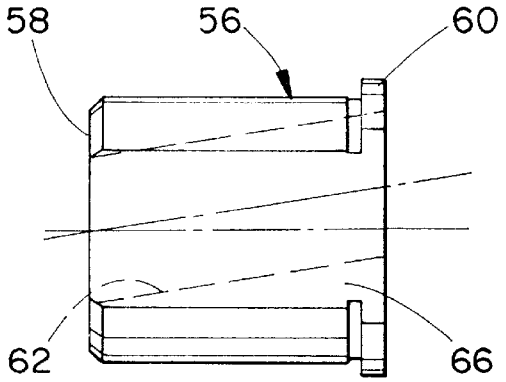
FIGS. 7A and 7B are front elevational and right-hand end views, respectively of a nine degree camber plug.
Figure 7B:
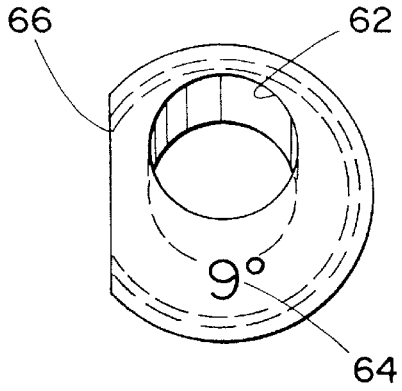

Yet another angle, for instance a nine degree angle, is formed in the camber plug shown in FIGS. 7A and 7B. The body, chamfer, and shoulder dimensions of this plug are substantially identical to those described with respect to FIGS. 4–6. This promotes ease of substitution of one plug for another in the camber tube 50. The nine degree counterbore is located so that at the shoulder end of the plug, the axis of the counterbore opening is substantially offset from the longitudinal axis of the plug body. At the chamfer end of the body, the counterbore axis and longitudinal axis of the plug body are substantially aligned. Thus, a comparison of FIG. 4B with FIG. 7B illustrates that the zero degree and nine degree camber plug exhibit substantially the same off-center relationship of the counterbore axis relative to the longitudinal axis of the camber plug.

Figure 8A:
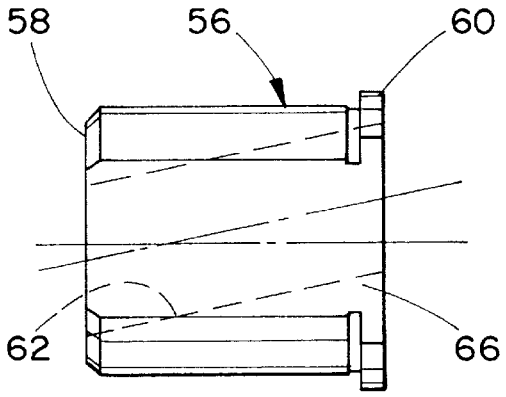
FIGS. 8A and 8B are front elevational and right-hand end views, respectively, of a twelve degree camber plug.
Figure 8B:
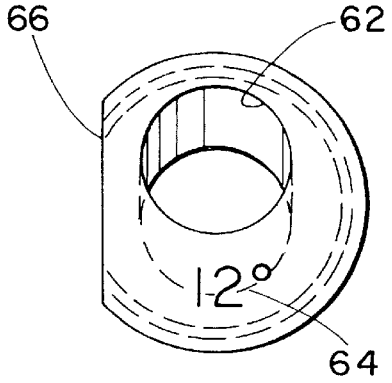

FIGS. 8A and 8B illustrate a camber plug of twelve degrees. Again, the axis of the counterbore at the shoulder end of the plug is slightly closer to the longitudinal axis of the plug than in the nine degree plug shown in FIG. 7B. Moreover, the counterbore axis at the chamfer end of the plug is slightly below that of the longitudinal axis of the plug. Again, indicia 64 is provided on the outer or shoulder end of the plug for ease of identification.

Each camber tube 50*a*, 50*b* is adapted to receive a pair of camber plugs in opposite ends. By way of example only, each camber tube may include camber plugs of zero degrees and three degrees. By orienting the camber tubes within the opposite ends of the axial tube 22 so that the zero degree camber plug faces outwardly, the counterbores 62 define recesses that receive the wheel axles. By merely removing the camber tube from the axle tube, rotating the camber tubes through one hundred eighty degrees so that the three degree camber plugs are now disposed outwardly, and then reinserting the camber tubes into the axle tube, the camber of the rear wheels is easily changed from zero degrees to three degrees. The same steps are followed to change the camber orientation, e.g., three degrees to six degrees, or six degrees to nine degrees, three degrees to twelve degrees, or any other combination. Thus, it will be understood that a wheelchair user may have one or more sets of camber tubes with desired camber plugs of different orientations. Consequently, the user can easily change from a first camber to a second wheel camber. Moreover, merely replacing one camber plug with another allows the wheel camber to be quickly and easily altered since the remaining geometrical relationships are unchanged.

Figure 9:
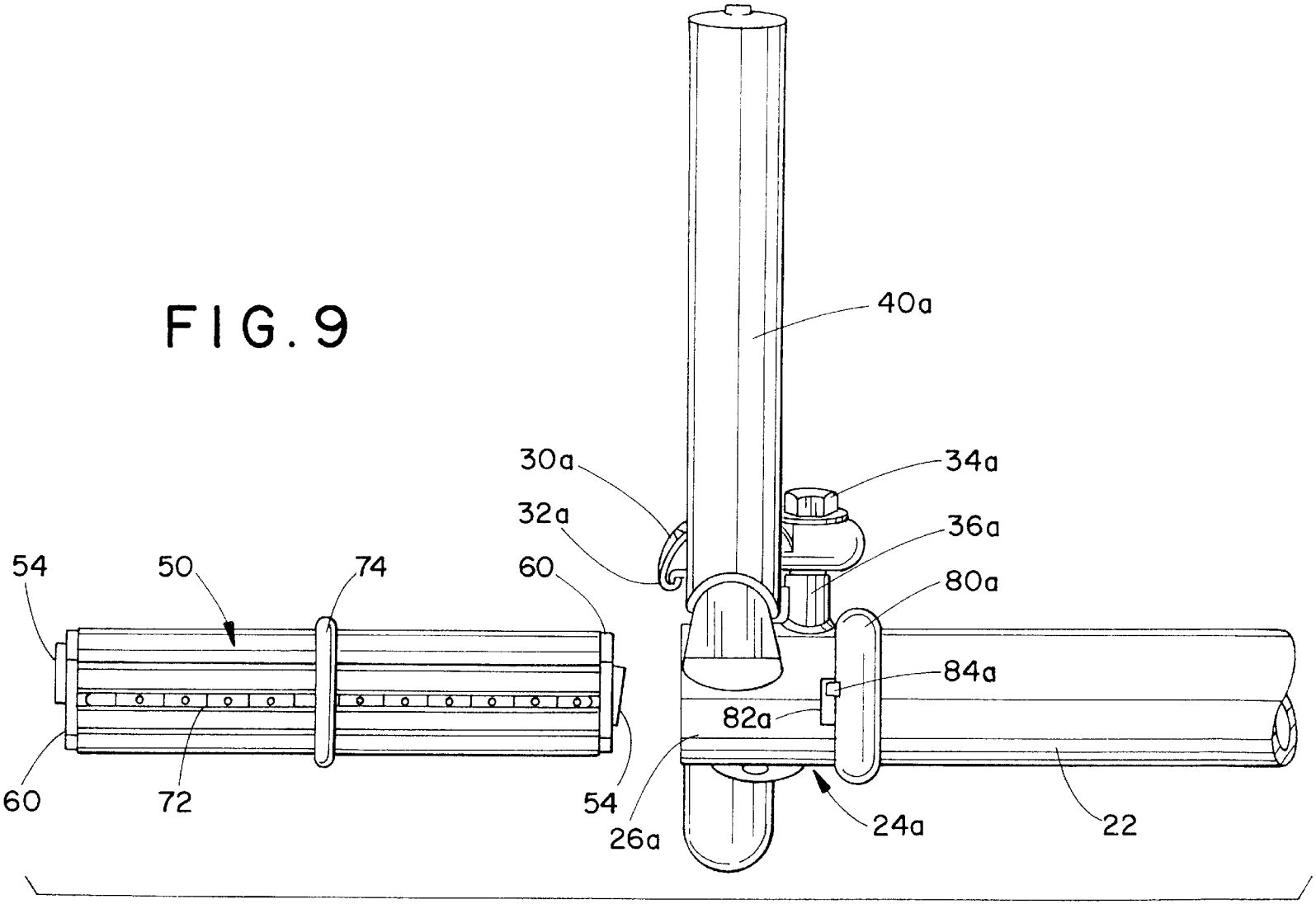
FIG. 9 is a rear elevational view of the lefthand side of the frame assembly where the camber tube has been removed from the frame for changing the camber.

When the camber of the rear wheels is increased, the upper portion of the rear wheels is disposed closer to the seat than the lower or ground-engaging portion of the wheels. It thus becomes necessary to alter the track width, or move the axles outwardly so that the upper portion of the wheels does not scrape against the seat or wheelchair user. FIGS. 3 and 9 particularly illustrate indicia 72 provided on the camber tube that provide for preselected axial positions of the camber tubes relative to the axle tube. For example, a series of markings are disposed on opposite sides of a centrally located indexing ring 74. As the camber angle increases, it is necessary to extend the axial location of each camber tube relative to the axle tube. Thus, the indicia 72 identify the desired axial position of each camber tube to correspond to a selected camber angle. By merely loosening and then re-tightening the fastener 34, this axial positioning can be easily altered.

The indexing ring also serves the additional beneficial purpose of holding the wheels in place during adjustment. Because of the friction fit arrangement, the camber tubes are not pushed inwardly when the bracket assembly 24 is loosened for adjustment reasons.

As the camber is adjusted, the side frame of the wheelchair is incrementally dropped as the camber angle increases. Since it is desired to maintain the side frame of the wheelchair substantially horizontal, this drop is compensated for by moving the location of the counterbore in each camber plug. Thus, the relationship between the counterbore locations in the zero degree, three degree, and six degree camber plugs is particularly evident by comparing FIGS.

4B, 5B, and 6B. At some point for a given diameter camber plug, however, the compensation can no longer be addressed by merely moving the location of the opening in the camber plug. That is, the dimensional constraints of the camber plug limit further compensation. One solution is to increase the diameter of the camber plug and continue to adjust the location of the opening to compensate for the drop in the side frame as the camber angle is increased. Another solution is to adjust the position of the counterbore, as illustrated by comparing FIGS. 7B and 8B, and also provide a further toe-in/toe-out adjustment.

Figure 10:
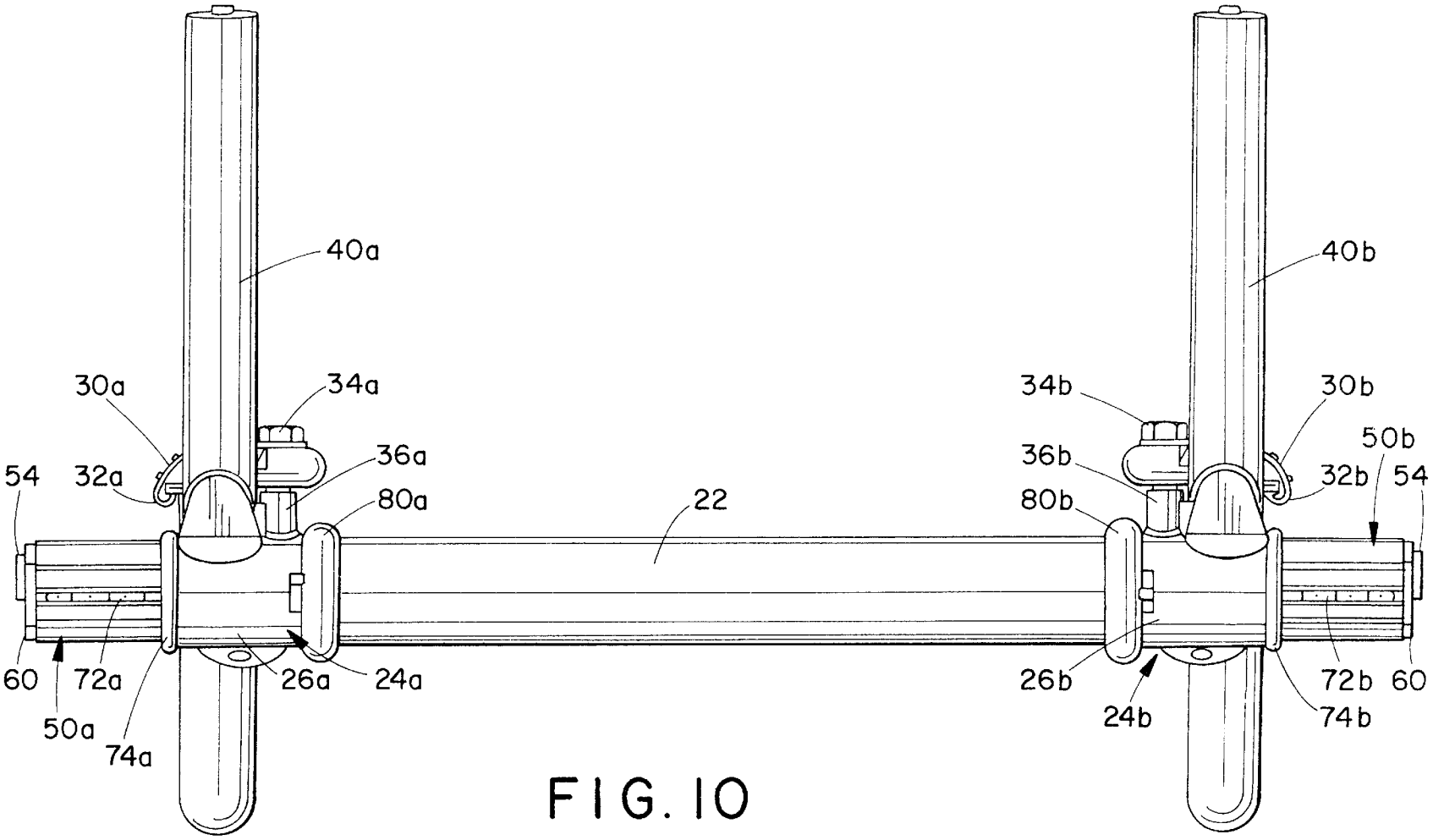
FIG. 10 is a rear elevational view of the frame assembly with the wheels removed and particularly illustrating the toe adjustment rings on the left-hand and right-hand sides in a first position.
Figure 11:
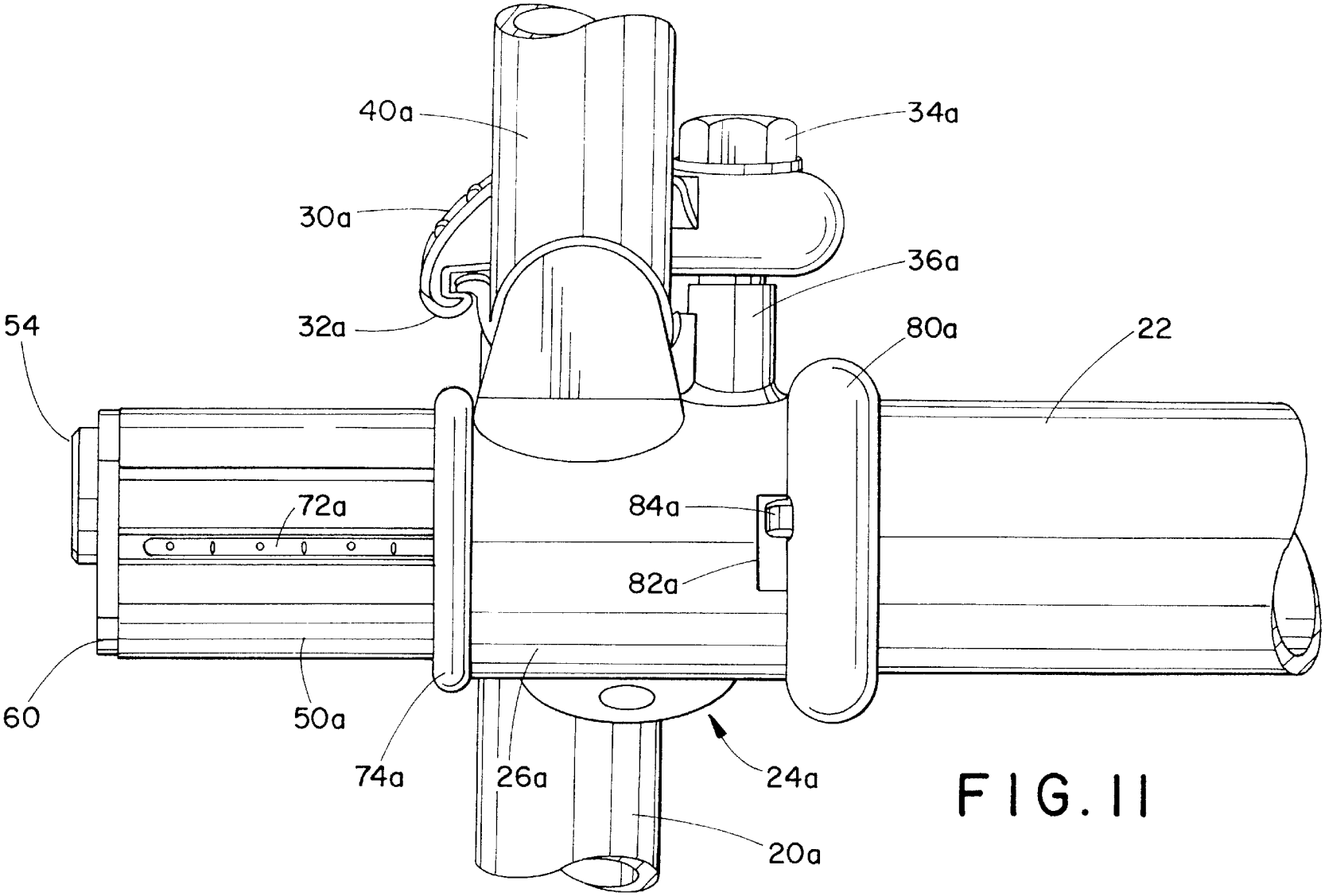
FIG. 11 is an enlarged rear elevational view showing the details of the left-hand toe adjustment ring in the first position of FIG. 10.
Figure 12:
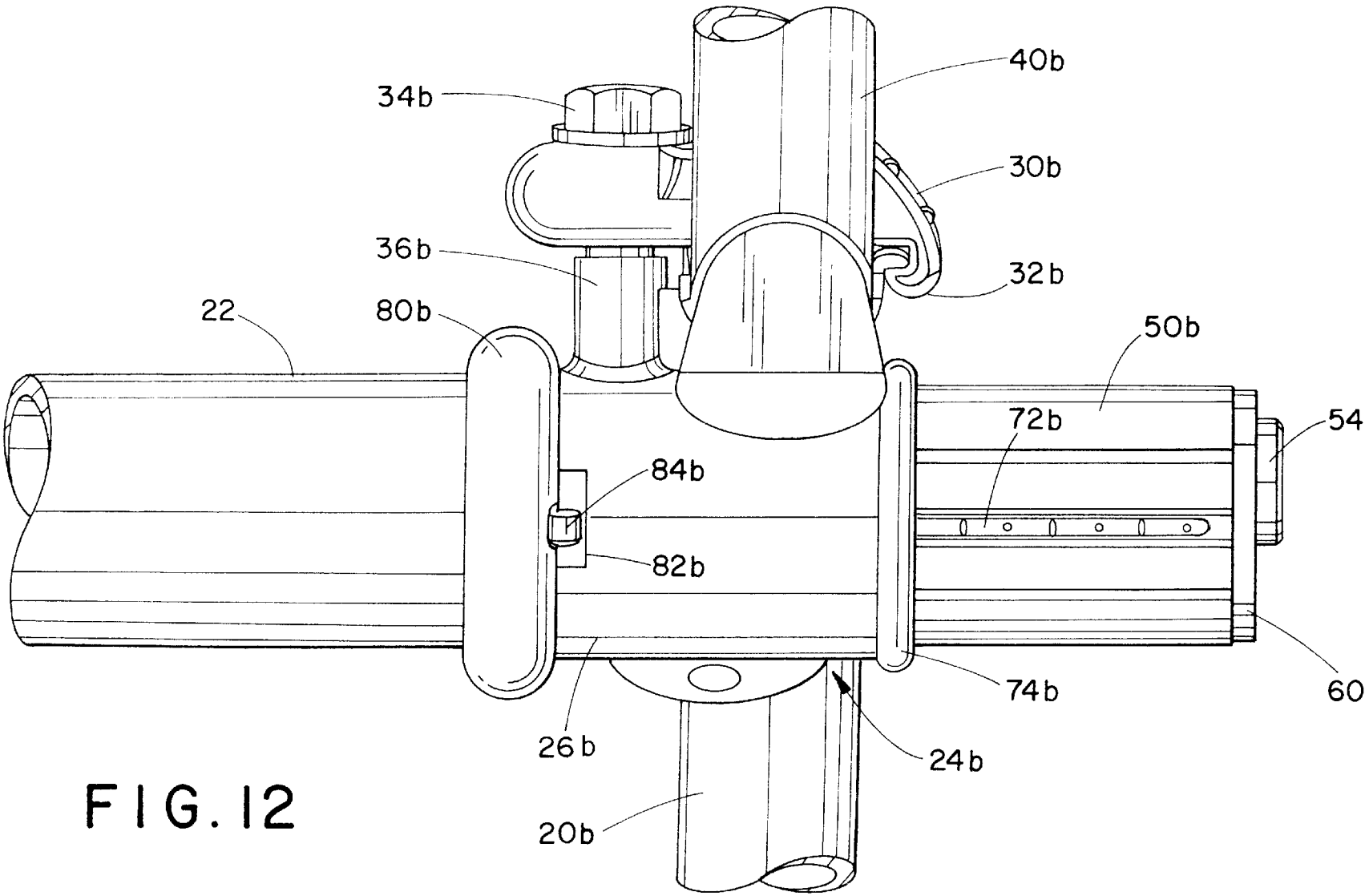
FIG. 12 is an enlarged rear elevational view of the right-hand toe adjustment ring in the first position shown in FIG. 10.

The desired degree of toe-in/toe-out adjustment is particularly described with reference to FIGS. 10–14. According to the preferred embodiment, a toe adjustment member defined as ring 80 cooperates with a recess or cut-out 82 formed in the frame bracket. Finger 84 extending from the toe adjustment ring is disposed at a first or upper end of the cut-out on the left-hand frame bracket 24*a*. This is a typical position for a zero degree, three degree, and six degree camber. The finger 84*b* associated with the right-hand toe adjustment ring 80*a* is disposed approximately midway between the ends of the cut-out 82*b*. Thus, as long as the camber adjustment is only between zero, three, and six degrees, for example, the rotational position of axle tube 22 remains as shown in FIG. 10 relative to the frame brackets. These particular positions are shown in greater detail in FIGS. 11 and 12 which show the left-hand and right-hand frame brackets in enlarged views. Again, as noted above, the relative position of each counterbore in the different camber plugs can compensate for the desired adjustment for these three cambers.

Figure 13:
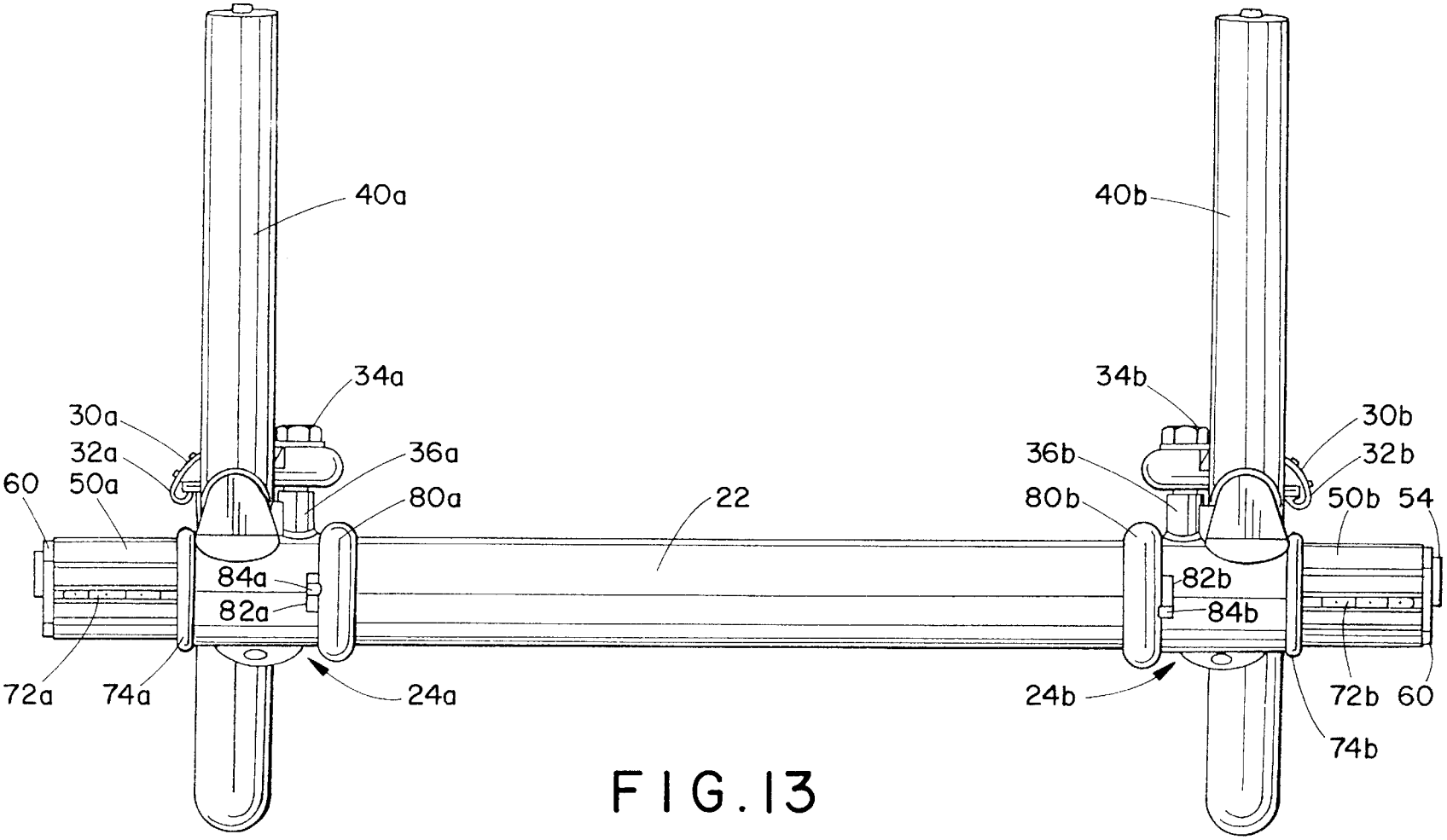
FIG. 13 is a rear elevational view of the frame where the axle tube and toe adjustment rings have been rotated to a second position.

When, however, a change occurs from one level, for example, from zero, three, or six degrees to the next level, for example, nine degree or twelve degree camber, the axle tube must be rotated a predetermined amount to further adjust the toe-in/toe-out position of the rear wheels. Since the camber tubes are keyed to the axle tube, rotation of the axle tube relative to the remainder of the frame simultaneously rotates the camber tubes (and camber plugs) to alter the toe-in/toe-out position of the rear wheels. The amount of rotation is controlled by abutment of the fingers in the respective recesses as shown in FIG. 13. As shown there, the entire axle tube has been rotated relative to the frame brackets to a second position when compared to the first position of FIG. 10. Finger 84*a* is disposed approximately mid-way in its corresponding recess 82*a*. The right-hand finger 84*b*, however, abuts against the lower end of the recess 82*b* in the frame bracket. This provides for precise toe-in/toe-out adjustment as desired by manufacturer specification.

Figure 14:
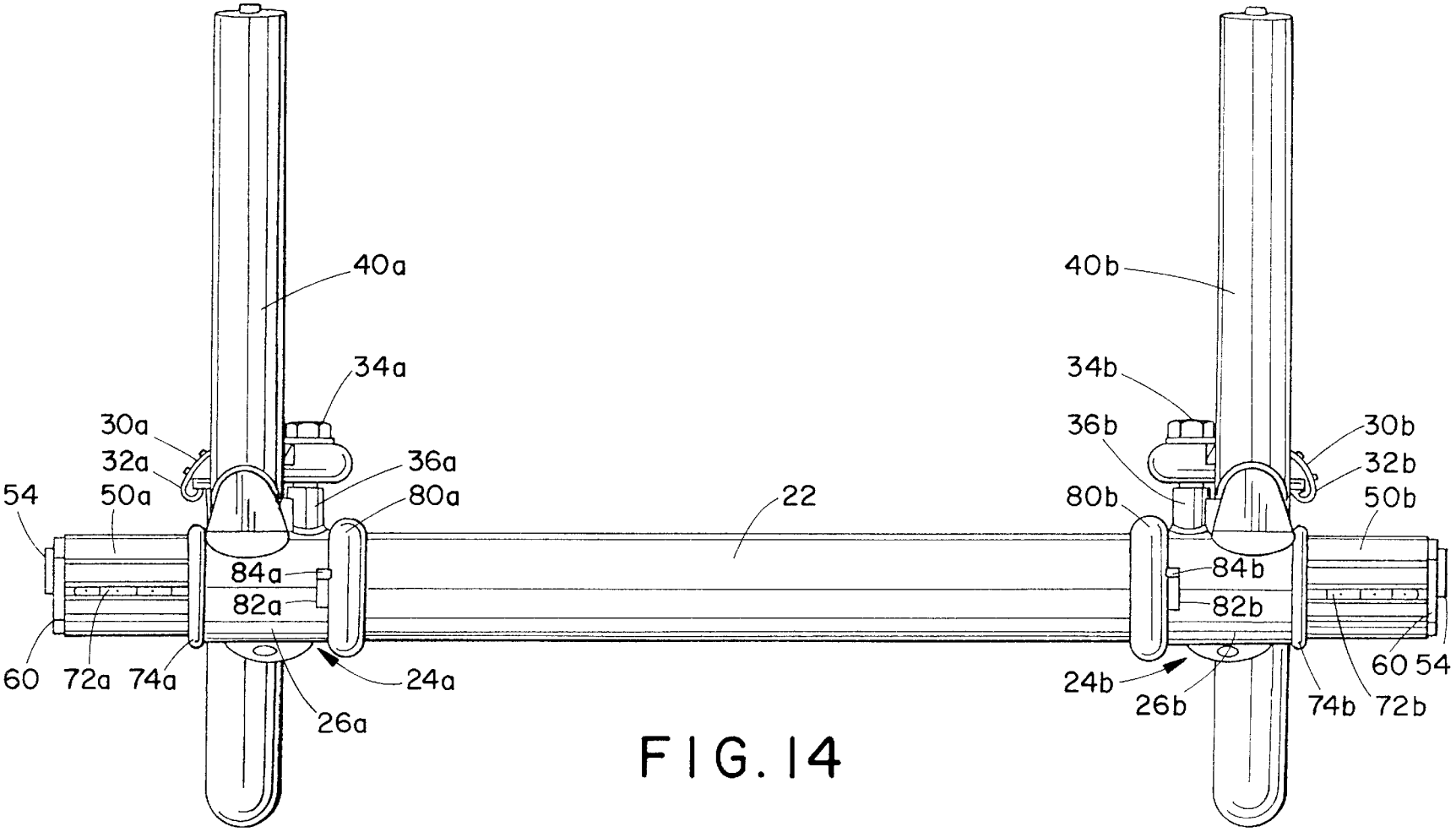
FIG. 14 is a rear elevational view of the frame with the toe adjustment rings in a third position.

FIG. 14 illustrates the desired position of the adjustment ring fingers where no toe-in/toe-out adjustment is required. For example, where changes are limited between a set of camber plugs where the positions of the openings compensate for the desired adjustment, e.g., among zero degree, three degree, and six degree cambers, or between nine degree and twelve degree cambers, both fingers abut against the upper end of the respective recesses. If the wheelchair user obtains a new set of camber plugs that go outside these ranges, then appropriate additional adjustment must be made for the toe-in/toe-out position as described and illustrated in FIGS. 10–13.

The toe adjustment ring 80 also secures the axle tube within the frame so that the axle tube does not slide out during adjustment when the clamp assemblies are loosened. Of course, other structural arrangements could be used to achieve this purpose but it is convenient to allow the ring 80 to serve the these dual purposes.

The invention has been described with reference to the preferred embodiment. Obviously, modifications and alterations will occur to others upon a reading and understanding of this specification. For example, the components of the wheelchair can adopt a variety of cross-sectional configurations or conformations, or be manufactured from a number of different materials without departing from the inventive features. Likewise, camber plug angles other than the exemplary angles described in the preferred embodiment can be used and the invention should not be deemed to be limited to the described angles. It is intended to include all such modifications and alterations insofar as they come within the scope of the appended claims or the equivalents thereof.

Having thus described the invention, it is claimed:

1. A wheeled apparatus for transporting a single user comprising:

a frame;

a seat mounted on the frame;

at least one small diameter wheel extending from the frame;

first and second enlarged diameter wheels rotatably mounted to the frame by first and second axles, respectively, and disposed on opposite sides of the seat; and a camber adjustment assembly secured to the frame including first and second camber members each including first and second recesses disposed at different angles that receive the first and second axles therein, respectively, the camber adjustment assembly selectively altering the camber of the enlarged diameter wheels by repositioning the first and second camber members so that the axles are selectively removed from one of the first and second angled recesses and inserted in the other of the first and second angled recesses.

2. The apparatus as defined in claim 1 wherein the first and second angled recesses are defined in each of opposite ends of the first and second camber members and the camber members are rotated through 180 degrees to alter the wheel camber.

3. The apparatus as defined in claim 1 wherein the first and second camber members each include removable first and second plugs disposed in opposite ends thereof, the opposite ends of the plugs having different angled recesses for selectively altering the wheel camber by positioning a desired end of the plugs to receive the wheel axles.

4. The apparatus as defined in claim 1 wherein the camber members are telescopically received in an axle frame member for wheel width adjustment thereof.

5. The apparatus as defined in claim 4 wherein the camber members are non-rotatably connected to the axle frame member.

6. The apparatus as defined in claim 5 wherein the camber members include indicia for defining the extent of telescopic receipt of the camber members in the axle frame member for a selected wheel camber.

7. The apparatus as defined in claim 4 wherein the axle frame member is rotatably connected to the frame for adjusting the toe-in/toe-out position of the enlarged diameter wheels.

8. The apparatus as defined in claim 7 wherein the axle frame member and frame include indicia for indicating the extent of rotation of the axle frame member relative to the frame necessary for altering the toe-in/toe-out adjustment for a selected camber.

9. The apparatus as defined in claim 4 wherein the axle frame member is secured to the frame by a bracket having a single fastener which can be loosened and re-tightened to adjust one of camber, toe-in/toe-out, track width and fore and aft center of gravity of the apparatus.

10. A lightweight wheelchair comprising:

a tubular frame assembly;

a seat secured to the frame assembly;

at least one front wheel extending from the frame; and first and second rear wheels rotatably mounted to the frame assembly by first and second axles, respectively, each axle being received in one of first and second camber members that each has first and second recesses at opposite ends thereof at different angles to allow the camber of the rear wheels to be changed by positioning a selected recess for receipt of the axles.

11. The wheelchair as defined in claim 10 further comprising an axle frame member secured to the frame assembly that receives the first and second camber members, and means for limiting rotation between the axle frame member and the camber members.

12. The wheelchair as defined in claim 10 further comprising camber plugs received in the opposite ends of the camber members to provide two different camber angles that can be selected by a wheelchair user.

13. The wheelchair as defined in claim 10 wherein the camber members are telescopically received in the axle frame member to vary the track width of the rear wheels.

14. The wheelchair as defined in claim 13 further comprising indicia on the camber members representing the desired position of the camber members in the axle frame member for a selected camber.

15. The wheelchair as defined in claim 10 wherein the axle frame member includes toe-in/toe-out indicia representing a desired angular position of the axle frame member for a selected wheel camber.

16. The wheelchair as defined in claim 15 wherein the axle frame member is secured to the frame assembly by a bracket having a single fastener for selectively altering the front to rear center of gravity of the wheelchair.

17. A wheel chair comprising: a frame; at least one castered wheel secured to the frame; first and second drive wheels rotatably mounted to the frame at a preselected camber; and a toe-in/toe out assembly including an axle frame member mounted to the frame and receiving the drive wheels in opposite ends thereof, wherein the axle frame member is rotatably connected to the frame for adjusting the toe-in/toe-out position of the enlarged diameter wheels, the axle frame member including indicia for properly selecting an angular position of the axle member and the drive wheels to the frame for a preselected camber.

18. The wheelchair as defined in claim 17 wherein the toe-in/toe-out adjustment assembly includes first and second limit stops that limit rotation of the axle frame member to define first and second toed positions of the drive wheels.

19. The wheelchair as defined in claim 18 further comprising a camber adjustment assembly including first and second camber members each having first and second recesses adapted to receive first and second axles associated with the first and second drive wheels, respectively, the first and second recesses having different angles so that the camber of the drive wheels can be selectively altered by positioning the axles in one or the other of the first and second recesses.

20. The wheelchair as defined in claim 19 wherein the camber members and the axle frame member are non-rotatably secured together.

21. The wheelchair as defined in claim 19 wherein the camber members are telescopically received in the axle frame member so that the axial position of the drive wheels can be varied in response to the preselected camber.

22. The wheelchair as defined in claim 19 wherein the first and second camber members include first and second camber plugs disposed in opposite ends thereof, each plug having one of the different angled recesses therein and the camber of the drive wheels is varied by rotating the camber members 180 degrees to present a different recess for receipt of the drive wheel axles.

23. The wheelchair as defined in claim 22 wherein the camber members include indicia thereon for positioning the camber members at a desired axial position relative to the axle frame member for a preselected camber.

* * * * *

UNITED STATES PATENT AND TRADEMARK OFFICE

CERTIFICATE OF CORRRECTION

PATENT NO. : 5,851,018
DATED : Dec. 22, 1998
INVENTOR(S) : Curran, et al.

It is certified that error appears in the above-identified patent and that said Letters Patent is hereby corrected as shown below:

On the title page, in item [56] References Cited, insert the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 4 | 8 | 5 | 2 | 8 | 9 | 9 | 08/01/89 | Kueschall | | | |
| | | 5 | 3 | 2 | 6 | 1 | 2 | 0 | 07/05/94 | Weege | | | |
| | | 5 | 3 | 3 | 3 | 8 | 9 | 4 | 08/02/94 | Mayes | | | |
| | | 5 | 6 | 6 | 2 | 3 | 4 | 5 | 09/02/97 | Kiewit | | | |
| | | | | | | | | | | | | | |

UNITED STATES PATENT AND TRADEMARK OFFICE

CERTIFICATE OF CORRRECTION

PATENT NO. : 5,851,018
DATED : Dec. 22, 1998
INVENTOR(S) : Curran, et al It is certified that error appears in the above-identified patent and that said Letters Patent is hereby corrected as shown below:

FOREIGN PATENT DOCUMENTS

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | WO | 91/ | 1 | 7 | 0 | 7 | 7 | 11/14/91 | WO | | | | |
| | | | | | | | | | | | | | | |

Signed and Sealed this

Thirteenth Day of April, 1999

*Attest:*

Q. TODD DICKINSON

*Attesting Officer*

*Acting Commissioner of Patents and Trademarks*